United States Patent [19]

Brauns et al.

[11] 4,137,856

[45] Feb. 6, 1979

[54] APPARATUS FOR FORMING A PERMANENT END LOOP IN A FABRIC WEB

[75] Inventors: Frank Brauns, Deerfield Beach; John L. Sullivan, Jr., Ft. Lauderdale, both of Fla.

[73] Assignee: Novatronics, Inc., Pompano Beach, Fla.

[21] Appl. No.: 840,561

[22] Filed: Oct. 11, 1977

[51] Int. Cl.[2] ..... D05B 3/12

[52] U.S. Cl. ..... 112/104; 112/121.27; 112/121.15; 270/61R

[58] Field of Search ..... 112/104, 113, 121.27, 112/147, 121.26, 121.11, 121.15; 156/443, 93; 270/67, 68, 61

[56] References Cited

U.S. PATENT DOCUMENTS

| | | | |
|---|---|---|---|
| 3,387,841 | 6/1968 | Menell et al. | 270/80 X |
| 3,497,116 | 2/1970 | Herron et al. | 112/121.15 |
| 3,699,907 | 10/1972 | Anderson et al. | 112/121.27 |
| 3,777,684 | 12/1973 | Friedman et al. | 112/121.27 X |
| 3,792,672 | 2/1974 | Friedman | 112/104 |
| 3,799,086 | 3/1974 | Block | 112/121.15 |
| 3,898,119 | 8/1975 | Barr et al. | 112/121.27 |
| 4,020,983 | 5/1977 | Asel et al. | 112/104 |
| 4,048,931 | 9/1977 | Hodgins | 112/121.27 |

*Primary Examiner*—Ronald Feldbaum
*Attorney, Agent, or Firm*—Oltman and Flynn

[57] ABSTRACT

In the present invention an elongated fabric web is advanced horizontally across a table by motor-driven rollers in a horizontally pivoted web forming device. The web forming device folds the web up along longitudinal fold lines before passing it through an opening in a metal fastener member held upright by a horizontally pivoted holder. The web forming device is pivotally retracted upwardly, and a web folding device folds over the leading end of the web and also rocks the holder to move the fastener member to a substantially horizontal position during this fold-over operation. A label is applied to the top of the web before the fold-over operation. The folded-over web and the applied label are slid across the table by a transfer device to a position where an automatic sewing machine sews a permanent end loop in the web and sews the label to the web next to this end loop.

40 Claims, 26 Drawing Figures

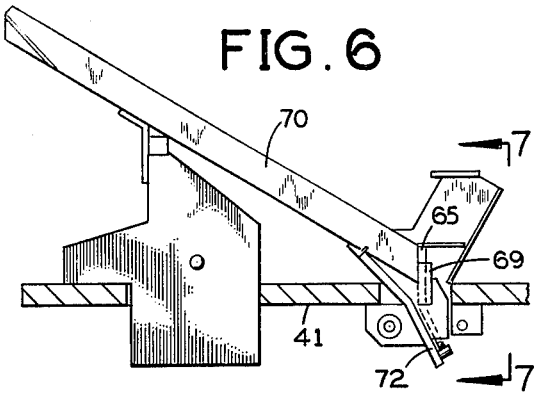
FIG. 6
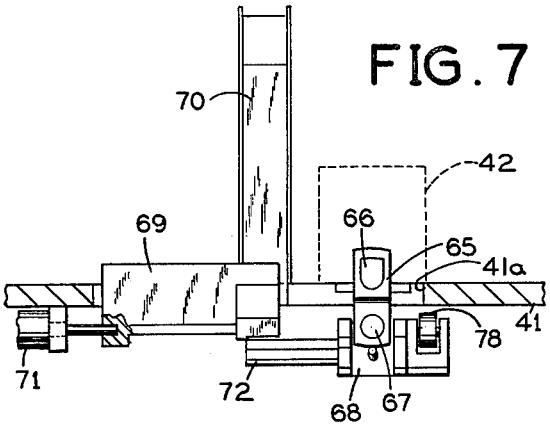
FIG. 7
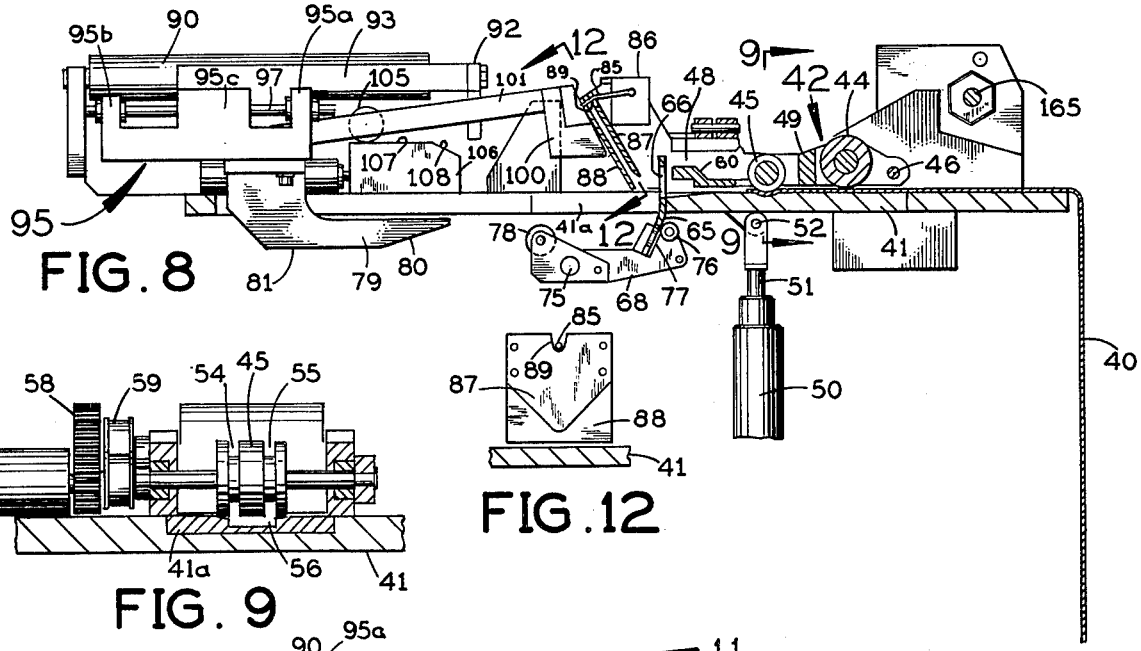
FIG. 8
FIG. 9
FIG. 12
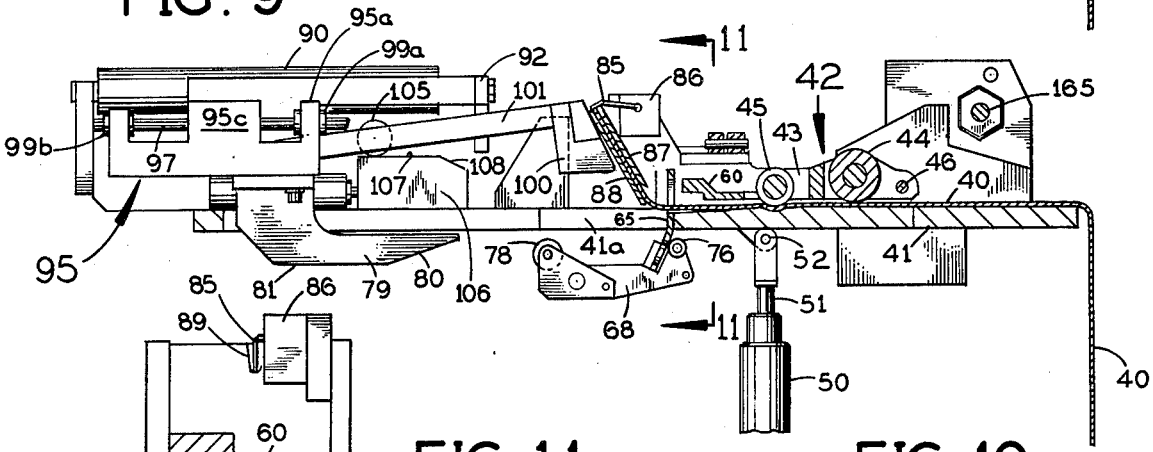
FIG. 10
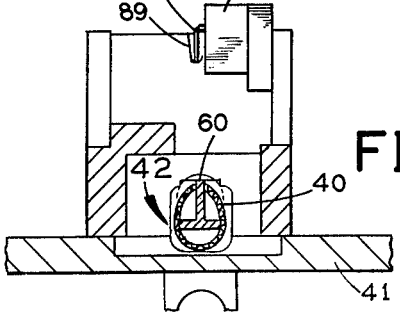
FIG. 11

122
145
139
121
125
137
120
144
143
127
140
123
124
128
125

136
138
122
135
140
121
137
139
120
124
123
142
141
42
87
42
88
52
76
78
51
68
75
50
53
120
145
125
126
140
143
138
144
132
136
127
123
124
128
121
135

139
137
120
111
110
151
150
40
125
41
111
101
92
90
98
96
105
80
81
79

APPARATUS FOR FORMING A PERMANENT END LOOP IN A FABRIC WEB

BACKGROUND OF THE INVENTION

British Pat. No. 989,052 discloses an apparatus for attaching a fabric strap to D-shaped metal rings in which the strap is folded longitudinally just before being inserted up through the horizontally disposed rings. After such insertion the rings are slid horizontally to fold the leading end of the strap back over the trailing portion, and then the extreme trailing end of the strap is folded up over the leading end and the three superimposed layers of the strap are sewed to each other.

U.S. Pat. Nos. 3,785,907 and 3,898,119 disclose an apparatus and method for assembling a fabric seat belt to an apertured anchor plate in which the strap is folded longitudinally before being inserted perpendicularly through the anchor plate. Following this, the leading end of the belt is folded over and secured to a trailing portion of the belt at the opposite side of the anchor plate.

SUMMARY OF THE INVENTION

The present invention is directed to a novel apparatus for forming a permanent end loop in an elongated fabric web, such as for an automotive seat belt.

The end loop in the web may extend through an apertured fastener member, such as a seat belt clip or buckle or floor anchor, or it may be formed without such a fastener member attached to it.

In the preferred embodiment of this invention, the fabric web is advanced across a horizontal table by motor-driven rollers on a horizontally pivoted, web forming device which directly overlies the table. The web forming device carries an upwardly and forwardly inclined guide on its front end for slidably receiving the leading end of the web. A limit switch at this guide is actuated by the leading edge of the web to operate an air cylinder for raising the web forming device to an upwardly retracted, raised position extending up from the table.

Where the web is to be assembled to an apertured fastener member, before reaching the inclined guide in the web forming device it is longitudinally folded in the web forming device and passed through an aperture in the fastener member. Preferably, one of the rollers in the web forming device has laterally spaced peripheral grooves for "cracking" the underlying web along longitudinal fold lines before it enters a forming cavity or passageway in the web forming device which folds its opposite sides up along these fold lines. A horizontally pivoted holder supports the apertured fastener member upright at an opening in the table below the web forming device behind the web forming cavity and just ahead of the inclined guide on the latter's front end.

A web folding device in front of the web forming device engages the leading end of the web as it slides out of the guide on the front end of the web forming device as the latter is raised pivotally. The web folding device folds the leading end of the web back over onto the trailing part of the web and holds it down.

As the web end is being folded over, a finger on the bottom of the web folding device rocks the holder for the apertured fastener member to tip the latter to a generally horizontal position.

Before this fold-over operation is completed, a vertically reciprocable head applies a label to the top of the web just behind where its leading end will be folded over.

A transfer device moves transversly above the web at the completion of the fold-over operation and it engages the folded-over end of the web and the label as the folding device is retracted away from this end of the web. The transfer device slides the web and label to one side across the table to where an automatic sewing machine is located for stitching the folded-over end of the web and the label to the underlying part of the web.

A principal object of the present invention is to provide a novel and improved apparatus for forming a permanent end loop in an elongated fabric web.

Another object of this invention is to provide such an apparatus which inserts the end of the web through an apertured fastener member before forming the end loop.

Another object of this invention is to provide such an apparatus that is particularly advantageous for use in the manufacture of automotive seat belts.

Further, more specific objects and advantages of this invention will be apparent from the following detailed description of a presently-preferred embodiment, which is shown in the accompanying drawings in which:

FIG. 6 is an elevational view of the mechanism in the present apparatus for feeding anchor plates or other apertured fastener members to where they are assembled to the fabric web;

FIG. 7 is a vertical cross-section taken along the line 7—7 in FIG. 6;

FIG. 8 is a view, partly in elevation and partly in vertical section, showing the fabric web advanced part way through the web forming device in the present apparatus;

FIG. 9 is a vertical cross-section taken along the line 9—9 in FIG. 8 at the web-fold roller in the web forming device;

FIG. 10 is a view similar to FIG. 8 showing the leading end of the web at the end of its travel through the web forming device;

FIG. 11 is a fragmentary vertical cross-section taken along the line 11—11 in FIG. 10;

FIG. 12 is a fragmentary cross-section taken along the line 12—12 in FIG. 8;

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 2:
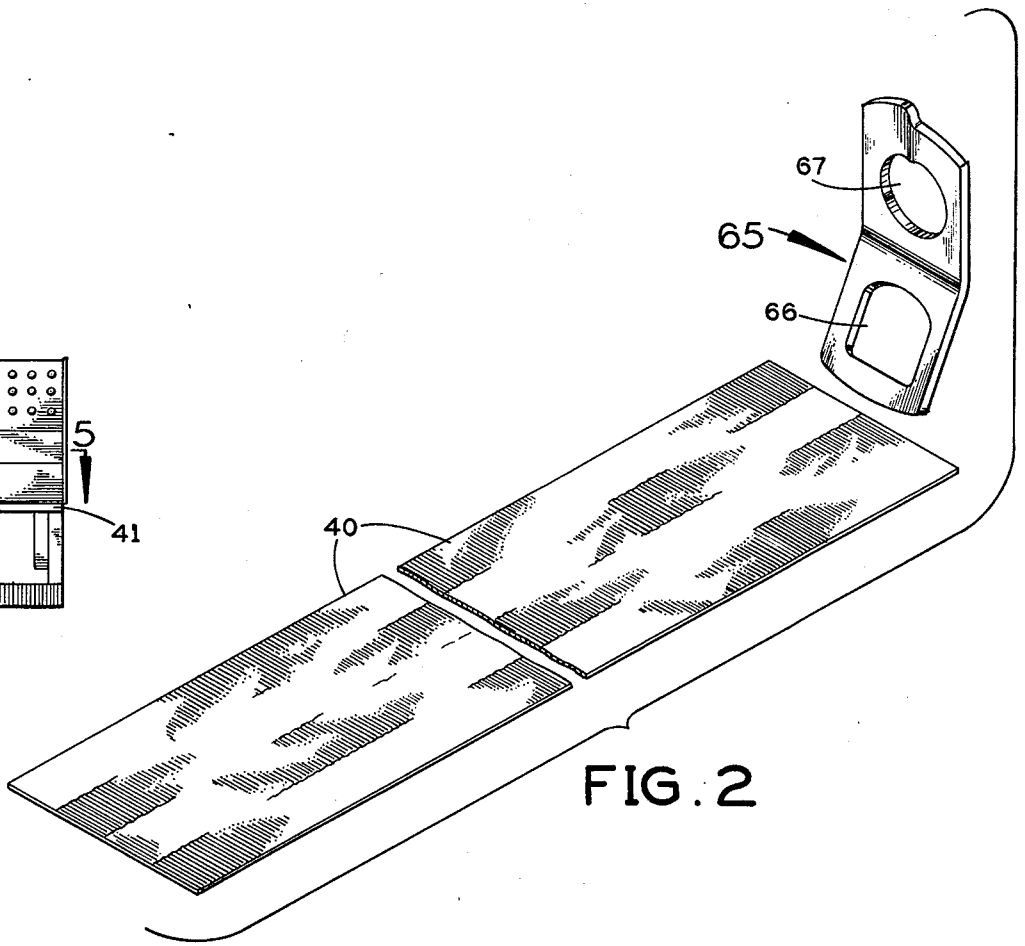
FIG. 2 is a fragmentary perspective view showing the seat belt fabric web and the floor anchor before assembly by the present apparatus.
Figure 1:
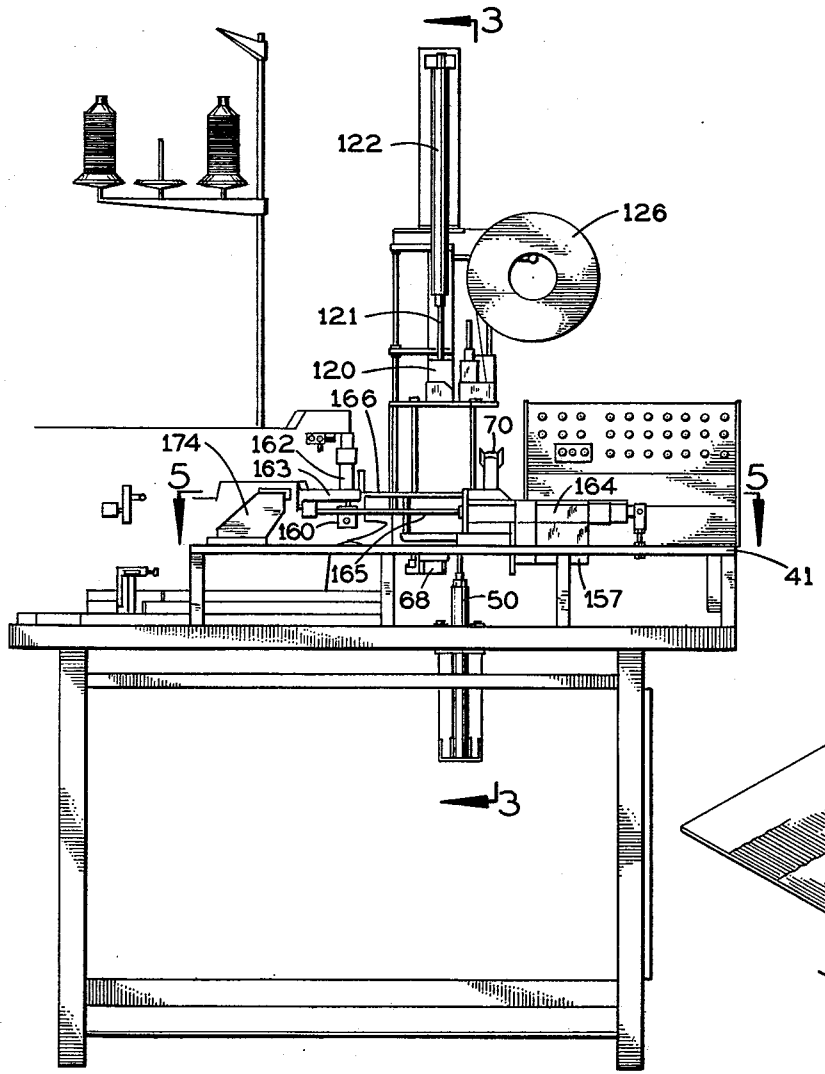
FIG. 1 is a front elevational view of the present apparatus.

Referring to FIG. 8, at the entry side of the machine the flexible fabric web 40 is advanced from right to left across the top of a horizontal table 41 by a web forming device designated generally by the reference numeral 42. The web 40 (FIG. 2) may have a width of 2 inches and may be of the type used for automotive seat belts, for example. Normally, the web forming device 42 directly overlies the table 41.

The web forming device 42 has a rigid frame 43 carrying a pair of rollers 44 and 45 which are spaced apart in succession along the path of the fabric web across the table 41. The frame 43 of the web forming device is horizontally pivoted at 46 at its back end for adjustment between a lowered, operative position directly overlying the table 41 substantially horizontally (FIGS. 8 and 10) and a raised, retracted position (FIGS. 16, 17 and 19) in which it extends up from the table substantially vertically.

Figures 3, 4:
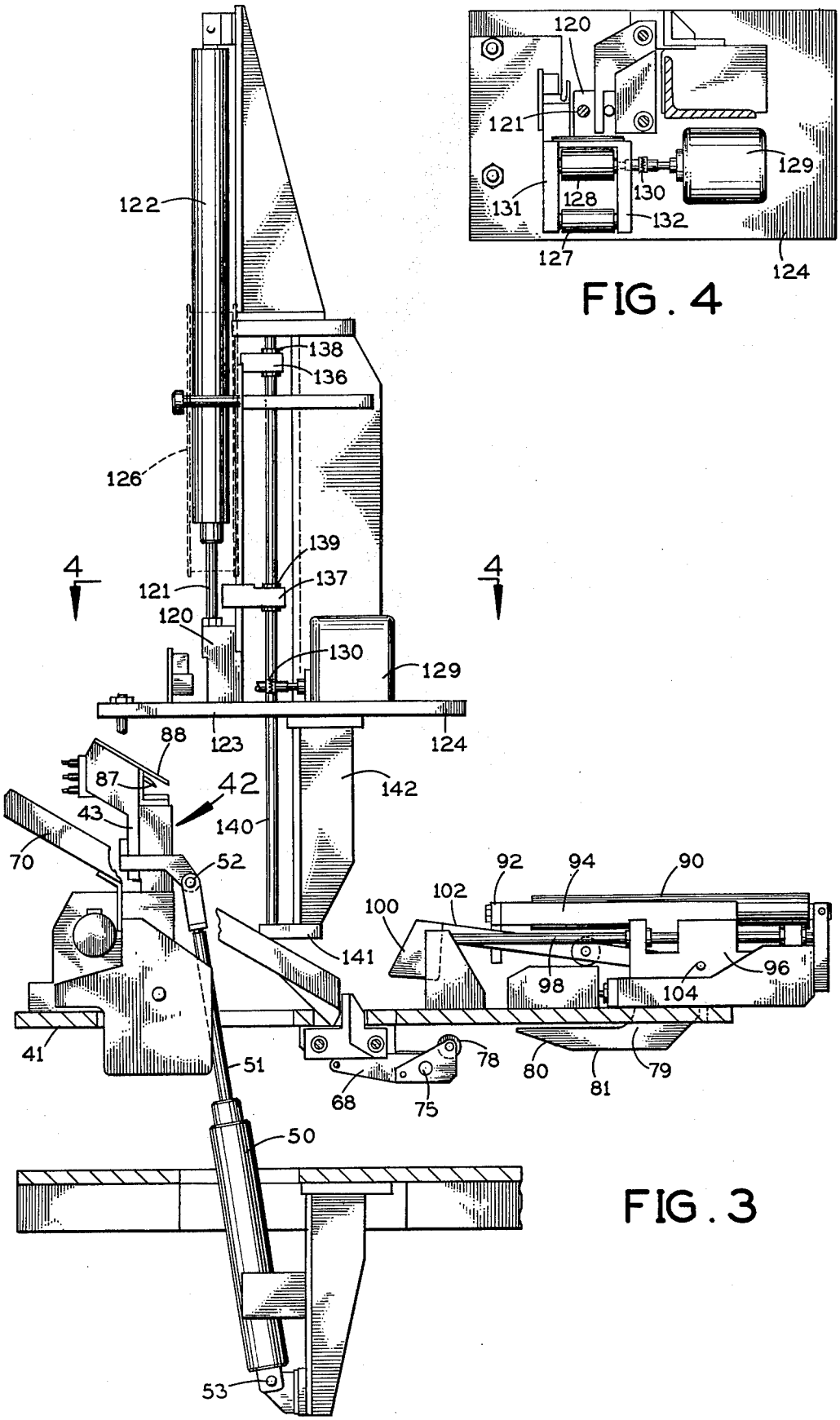
FIG. 3 is a vertical cross-section taken along the line 3—3 in FIG. 1, but with the web forming device in its raised, inoperative positon.
FIG. 4 is a horizontal cross-section taken along the line 4—4 in FIG. 3.
Figure 5:
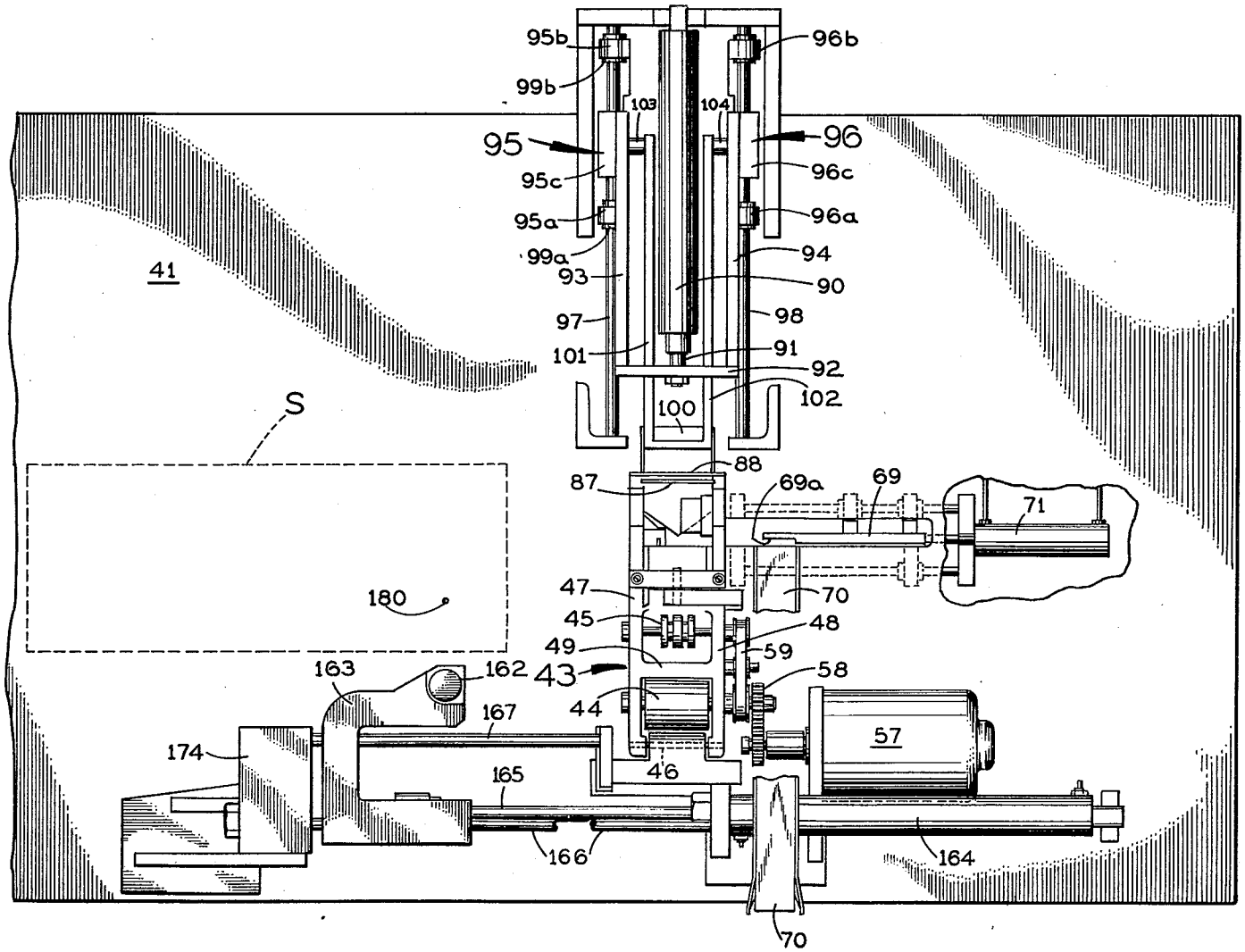
FIG. 5 is a top plan view of a portion of the present apparatus, taken along the line 5—5 in FIG. 1.
Figure 16:
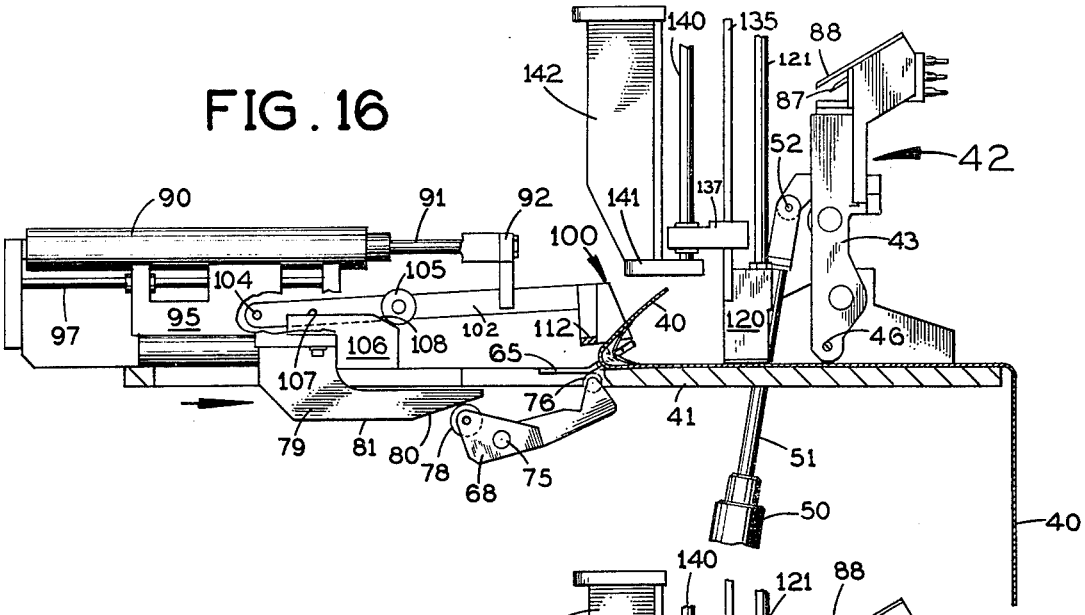
FIG. 16 is a view generally similar to FIG. 13 but taken at the opposite side of the web folding device in the present apparatus when the label is being applied to the web and before the leading end of the web is completely folded over.
Figure 17:
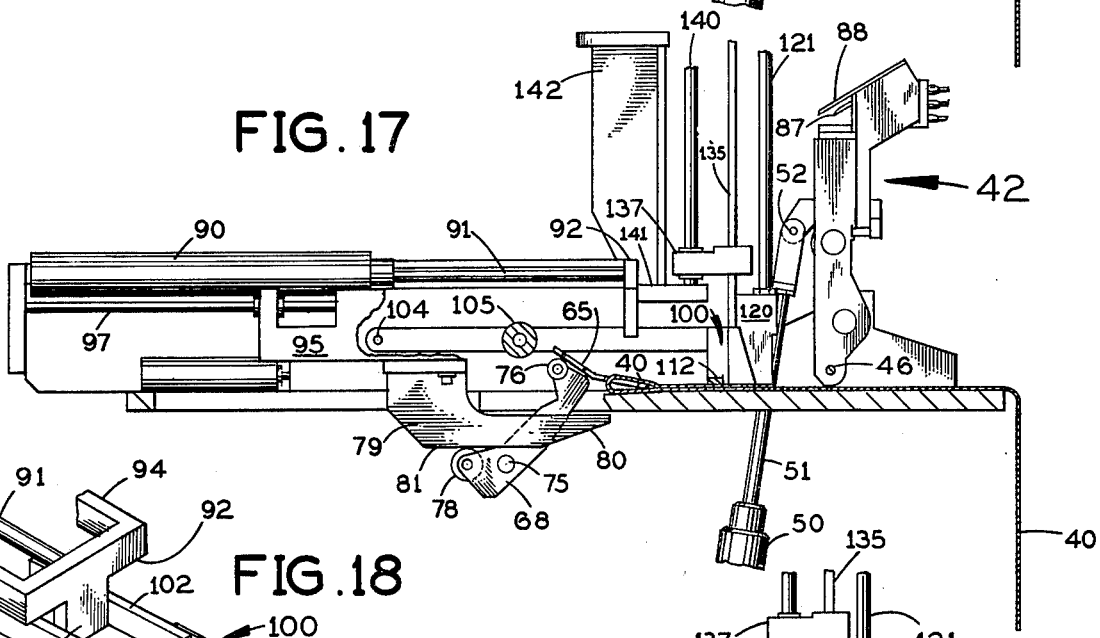
FIG. 17 is a view similar to FIG. 16 and showing the leading end of the web completely folded over and the label being held on the web by the label-applying mechanism.
Figure 19:
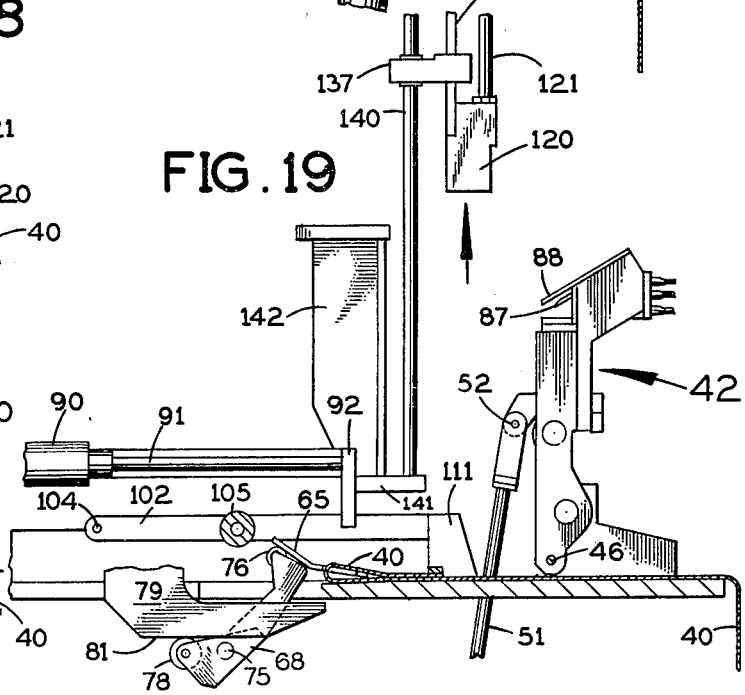
FIG. 19 is a view similar to FIG. 17 showing the leading end of the web held folded over and the label-applying mechanism retracted upwardly.

As shown in FIG. 5, the frame 43 of the web forming device has opposite longitudinal sides 47 and 48 connected by a rigid cross piece 49 between the rollers 44 and 45. The web forming device is raised and lowered by an air cylinder 50 (FIG. 8) operating a piston whose upwardly extending piston rod 51 is pivotally connected at 52 to one side of the frame 43. The lower end of the cylinder 50 is pivotally mounted so that it can shift from the vertical position of FIGS. 8 and 10, when the piston rod is retracted and the web forming device 42 is down, to a position at a slight angle to the vertical as shown in FIGS. 16, 17 and 19, when the piston rod is extended and the web forming device 42 is up. This pivotal support for the cylinder 50 is shown at 53 in FIG. 3.

The first roller 44 in the web forming device is a drive roller and it is externally knurled for positive traction with the top of the fabric web 40. The second roller 45 is formed with two laterally spaced grooves 54 and 53 in its periphery, as best seen in FIG. 9. These grooves "crack" the fabric web as it passes beneath roller 45, and this action facilitates the latter folding of the web longitudinally. The table 41 carries an insert 41'a formed with a shallow rectangular recess 56 beneath the roller 45 and extending laterally from the outer edge of roller groove 54 to the outer edge of the other roller groove 55. This recess 56 cooperates with roller 45 to "crack" the fabric web as it passes beneath this roller.

Referring to FIG. 5, both the drive roller 44 and the grooved fold roller 45 in the web forming device are driven from an electric motor 57, through a gear drive 58 acting between motor 57 and the shaft of drive roller 44 and a belt and pulley drive 59 acting between the shafts of rollers 44 and 45. The axis of the drive shaft of motor 57 coincides with the pivot axis 46 of the frame 43 of the web forming device, so that the pivotal adjustment of the latter does not disconnect the gear drive 58.

The fold roller 45 in the web forming device causes the corners of the leading edge of the web to begin moving upward as they pass beneath this roller. Referring to FIG. 11, just beyond the fold roller 45 (i.e., to the left of it in FIG. 8) the web forming device presents a forming cavity which deflects the corners of the leading edge progressively upward and later inward as the web continues to advance, so that the web is formed from its original flat configuration into approximately an egg-shaped cross-section. The web forming device carries an interior core piece 60 (FIG. 11) of inverted T-shaped cross-section around which the advancing web is folded up inside the forming cavity.

The purpose of this longitudinal folding operation is to shape the web so that it can pass easily through an opening in a metal fastener member, such as a floor anchor on a belt buckle or clip or the like, where the width of the flat web is greater than that of the opening.

FIG. 7 shows a floor anchor 65 as the apertured fastener, having an upper opening 66 which is substantially U-shaped in outline for passing the folded web. The lower half of this fastener member is bent at a slight angle to its upper half, as shown in FIG. 8, and it presents a circular opening 67. The apertured fastener member 65 is shown in more detail in FIG. 2.

A holder 68 positions the fastener member 65 as shown in FIG. 8, with its top half vertical, as the leading end of the Web is advanced horizontally through the web forming device 42. The fastener member 65 extends up through an opening 41*a* in the table 41 directly above the holder 68. The upper opening 66 in the fastener member is positioned to pass the leading end of the web as it emerges from the web forming cavity in a generally egg-shaped cross-section.

Referring to FIG. 7, the holder 68 receives the fastener members 65 one at a time from a transversely reciprocable transfer plate 69 at the lower end of an inclined chute 70 down which the fastener members slide by gravity. The chute 70 is positioned at one side of the holder 68. The transfer plate 69 is reciprocated by an air cylinder 71 (FIG. 5). The transfer plate has a rectangular recess 69a at its free end which faces toward the bottom of the chute 70 to snugly receive the lowermost fastener member from the chute when the transfer plate is retracted, as shown in FIG. 5. A fixed guide rail 72 (FIGS. 6 and 7) extends from below the lower end of the chute 70 over to the holder 68. The transfer plate 69 slides the fastener member across this guide rail after it drops out of the chute, moving it over onto the holder 68 in the web-receiving position shown in FIG. 7.

The holder 68 is pivotally adjustable about a horizontal pivot axis at 75 (FIG. 8). At its right end in FIG. 7 the holder carries a horizontal roller 76 at the upper end of an inclined wall 77. The lower half of the fastener member 65 extends up along this wall and bears against roller 76 when the fastener member is in its upright, web-receiving position, as shown in FIG. 8 and 10. At its opposite end the holder 68 carries a second horizontal roller 78 at the top. Roller 78 is offset to the right of the fastener member 65 on the holder, as shown in FIG. 7.

A finger 79 with an upwardly inclined bottom edge 80 at its back end is longitudinally reciprocable horizontally toward and away from the holder 68. This finger has a horizontal bottom edge 81 extending forward from the inclined bottom edge 80. When the finger 79 is displaced to the right in FIG. 10, the inclined bottom edge 80 is engageable with the roller 78 to rock the holder 68 counterclockwise from the normal position shown in FIG. 10 to the partially tilted position shown in FIG. 16. Continued movement of the finger 79 in this direction causes its horizontal bottom edge 81 to engage the roller 78 and rock the holder 68 still farther counterclockwise to the position shown in FIG. 17.

This movement of finger 79 takes place after a predetermined length of the web has passed through the upper opening 66 in the fastener member 65 held upright on the holder 68. It begins when the leading edge of the web engages a pivoted actuator 85 for a limit-switch 86. As shown in FIG. 10, this switch actuator is positioned near the upper end of an upwardly inclined guide formed by parallel, closely spaced plates 87 and 88 located a short distance to the left of the position of the fastener member 65 on holder 68 in FIGS. 6 and 10. As shown in FIGS. 12, the upper guide plate 87 has a generally V-shaped bottom edge with a rounded bottom tip behind which the leaing edge of the web 40 slides up into the inclined guideway. At its upper end the upper guide plate 87 has a slot 89 which freely passes the end of the switch actuator 85 and permits the latter to move upward when engaged by the upwardly moving leading edge of the web.

As shown in FIG. 3, the guide plates 87 and 88 are rigidly attached to the frame 43 of the web forming device 42 at the latter's front end.

FIG. 8 shows the position of the parts before the leading edge of the web reaches the apertured fastener member 65 on the holder 68. FIG. 10 shows their position after the leading edge of the web has passed through the upper opening 66 in the fastener member 65 and has moved up along the inclined guideway between plates 87 and 88 and has engaged and operated the switch actuator 85.

The operation of switch 86, in response to the engagement of the switch actuator 85 by the leading edge of the web, first actuates the air cylinder 50 to raise the web forming device 42 (including the web guide plates 87 and 88 on its front end) up to the out-of-the-way position shown in FIGS. 3 and 16. In moving to this position, the guide plates 87 and 88 begin folding the leading end of the web over across the fastener member 65 as they slide past this part of the web and release it from between them.

The operation of switch 86 by the leading edge of the web also causes a horizontal air cylinder 90 to be operated to move the finger 79 to the right from the position shown in FIG. 10. As shown in FIG. 5, a piston inside this cylinder is connected to a piston rod 91 whose outer end is bolted to a rigid cross piece 92. The opposite ends of this cross piece are attached to rigid side plates 93 and 94, which extend longitudinally of the cylinder 90 on opposite sides of it. At their ends away from the cross piece 92 the respective side plates 93 and 94 are connected to slides 95 and 96, respectively, which are slidably mounted on fixed horizontal guide rods 97 and 98 extending longitudinally of the cylinder 90 on opposite sides of it.

As shown in FIG. 10, the slide 95 is of generally E-shaped configuration, with upwardly extending, opposite end legs 95*a* and 95*b* carrying respective anti-friction bushings 99*a* and 99*b* that slidably engage the guide rod 97. The slide 95 also has an upwardly extending middle leg 95*c* through which the guide rod extends freely. The other slide 96 is identical and is slidably mounted on its guide rod 98 in the same fashion.

The finger 79 is bolted to the bottom of the slides 95 and 96 so that it moves to the right in FIG. 10 in response to the actuation of air cylinder 90. As shown in FIG. 16, during such movement the inclined bottom edge 80 of the finger first slides over roller 78 and rocks the holder 68 counterclockwise. In turn, the roller 76 on the opposite end of the holder engages the fastener member 65 and rocks it clockwise in FIGS. 10, 16 and 17.

This rocking movement of the holder 68 takes place in timed relation with the movement of the web forming device 42 up to its out-of-the-way position (FIG. 16), so that the rocking of the fastener member 65 is correlated with the beginning of the web fold-over operation by the guide plates 87 and 88 on the front end of the web forming device 42. FIG. 16 shows an intermediate position of the parts, in which the holder 68 and the fastener member 65 have not reached their final position and the leading end of the web has not been folded over completely.

The completion of the web fold-over operation is done by a longitudinally reciprocable, horizontally pivoted folding device having a presser head 100 at its back end which normally is in a raised position close to the guide plates 88 and 87 on the front end of the web forming device 42, as shown in FIG. 8. This presser head is attached to the rear end of a pair of rigid arms 101 and 102. As shown in FIG. 5, the respective opposite ends of these arms are pivotally connected at 103 and 104 to the respective side plates 93 and 94. The arms 101 and 102 extend longitudinally between these sides plates and the air cylinder 90.

The arms 101 and 102 of the folding device carry a horizontal roller 105 which engages the top of a stationary cam block 106 (FIG. 8). The cam block has a horizontal top face 107 for most of its length and a downwardly inclined top face 108 at its back end. When the roller 105 engages the horizontal top face 107 of the cam block (FIGS. 8 and 10), the presser head 100 is in its raised position.

The presser head 100 is lowered when the slides 95 and 96 move from left to right in response to the actuation of the air cylinder 90, as described. During such movement of the slides, the arms 101 and 102 which carry the presser head 100 move with the slides, and the roller 105 rolls across the horizontal top face 107 of the cam block 106 and then down across the inclined top face 108, as shown in FIG. 16, to begin lowering the presser head 100 by gravity.

Figure 18:
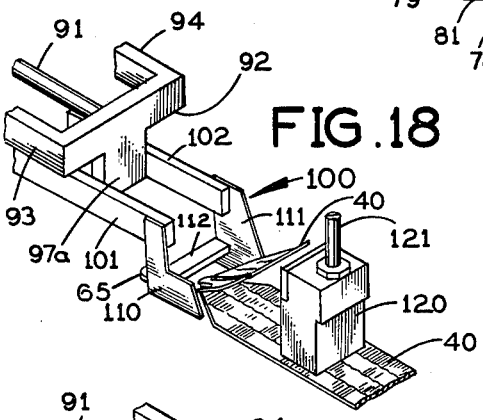
FIG. 18 is a fragmentary perspective view showing the web-engaging end of the web folding device in the present apparatus and showing the label-applying mechanism in its down position.
Figure 20:
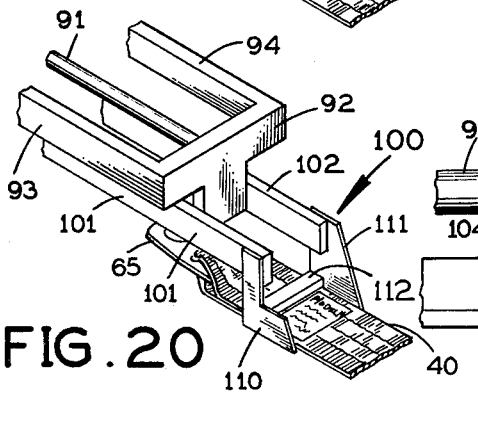
FIG. 20 is a fragmentary perspective view similar to FIG. 18 and showing the leading end of the web completely folded over.

As shown in FIG. 18, the presser head 100 has vertically extending opposite sides 110 and 111, which are rigidly attached respectively to the pivoted arms 101 and 102, and a cross piece 112 near the bottom which extends horizontally between these sides. This cross piece has a knurled bottom face for engagement with the web. During the advance and the lowering of the presser member, this cross piece 112 slides down over the leading end of the partly folded over web (FIG. 18) and finally folds it down against the underlying trailing part of the web (FIG. 20). This action is shown in FIGS. 16 and 17, also. In the final position of the parts (FIG. 17) the roller 105 has moved completely past the cam block 106, so that the combined weight of the presser head 100, its support arms 101 and 102, and the roller 105 is effective to hold the presser member down on top of the folded-over web.

As shown in FIG. 18 the cross piece 92 on the outer end of the piston rod 91 has a depending reduced segment 92*a* which extends down between the longitudinal arms 101 and 102 of the folding device to guide their up and down movement.

During the final movement of the cylinder-operated slides 95 and 96 from the position shown in FIG. 16 to the position shown in FIG. 17, the horizontal surface 81 on the bottom of the finger 79 moves into engagement with the roller 78 on the holder 68 for the apertured fastener member 65. The holder 68 is rocked farther counterclockwise in these Figures and the fastener member 65 is rocked clockwise to the final position shown in FIG. 17, in which what was originally its upperhalf (where the web receiving opening 66 is located) lies horizontal and its remaining half is tipped up at a slight angle.

Before the leading end of the web 40 is completely folded over, as described, a label is applied to the trailing part of the web (to the right of the fastener member 65 in FIG. 16) by a vertically reciprocable lable-applying head 120. As shown in FIG. 3, this head is attached to the lower end of a piston rod 121 whose upper end is connected to a piston reciprocable inside a vertically disposed air cylinder 122 above the table 41. Normally, the head 120 is retracted upward by the cylinder 122 and its piston to the position shown in FIG. 13, in which its bottom face is slightly above a vertical opening 123 formed in a horizontal shelf 124 spaced above the table 41.

Figures 13, 14, 15:
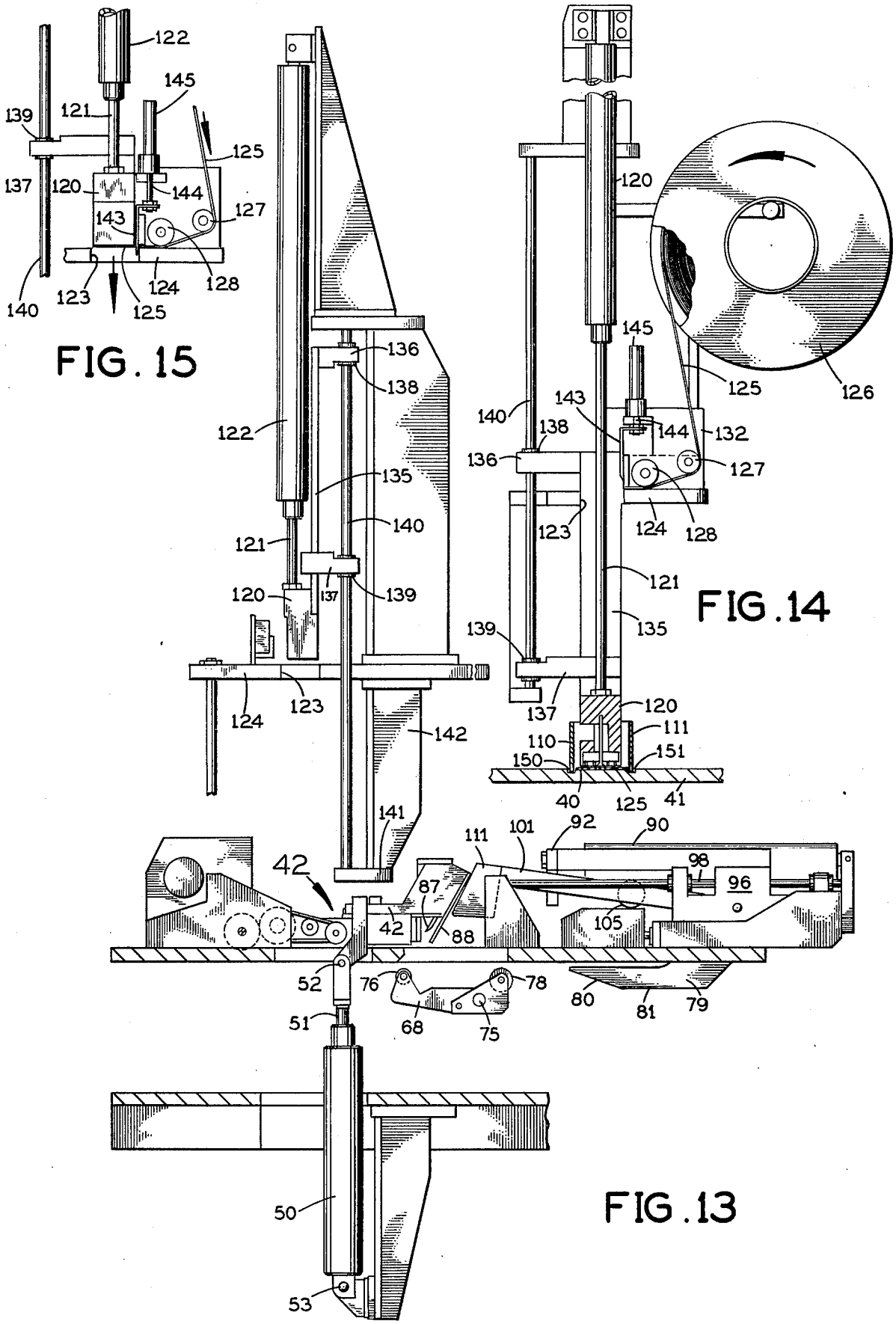
FIG. 13 is a view similar to FIG. 3 in a later stage of the operating cycle of the apparatus.
FIG. 14 is a fragmentary elevational view, with parts broken away for clarity, showing the label-applying mechanism in the present apparatus in its lowered, label-applying position.
FIG. 15 is a fragmentary elevation showing the label-applying mechanism retracted upwardly.

A continuous strip 125 of labels (separated by perforation lines) extends down to the shelf 124 from a horizontally rotatable reel 126 (FIG. 14). The label strip passes down around an idler roller 127 and beneath a motor-driven drive roller 128 located next to the opening 123 in the shelf 124. As shown in FIG. 4, the shelf supports a small motor 129 whose shaft is coupled to the drive roller 128 through a toothed clutch 130. The drive roller 128 and the idler roller 127 are rotatably supported between a pair of vertical walls 131 and 132 which extend up from the shelf 124.

The individual label at the leading lower end of the strip 125 extends across the shelf opening 123 and operates a limit switch (not shown) to stop the motor 129 each time the label roll is advanced by the length of a single label.

A cutting knife 143 (FIG. 14) is connected to the lower end of a piston rod 144 for a piston that is reciprocable in a vertical air cylinder 145. The knife 143 is slidably reciprocable across the edge of the shelf opening 123 nearest the drive roller 128.

With the label applying head 120 retracted upward just past the shelf 124 (FIG. 15) and a single label projecting horizontally across the top of the shelf opening 123, the air cylinder 145 is actuated to raise the knife 143 for cutting off this label from the remainder of the label roll as the label-applying head 120 moves down through this opening.

During the downward stroke of the head 120 a vacuum is maintained at its bottom face by a suitable arrangement, the details of which are omitted as unnecessary. This vacuum insures that the severed label will be held against the bottom of the head until it rests on top of the web 40, at which time the vacuum may be released.

As shown in FIG. 13, the label-applying head 120 is attached to the lower end of a vertical plate 135. Upper and lower slides 136 and 137 are attached to this plate and they carry respective anti-friction bushings 138 and 139 which are slidable along a vertical fixed guide rod 140. This arrangement assures that the head will move up and down precisely vertically.

The lower end of the guide rod 140 is supported by a horizontal shelf 141 attached to the lower end of a fixedly mounted angle iron 142. As shown in FIGS. 16 and 17, this shelf 141 is positioned in the path of the cross piece 92 on the horizontally reciprocable piston rod 91. When the piston rod 91 is fully extended (FIG. 17) the cross piece 92 abuts against the front edge of shelf 141. Before this happens (FIG. 16) the label-applying head 120 will have been moved down all the way to apply a label to the web 40 (FIG. 18) and hold them down on the table 41. Then, as shown in FIG. 17, as the piston rod 91 is more fully extended the leading end of the web will be folded over completely to a position in which its leading edge is next to the label (FIG. 20). The knurled sufrace on the bottom of the cross piece 122 in the presser member 100 of the folding device slides the folded-over end of the web across the underlying trailing part of the web until the leading edge of the web engages the adjacent edge of the head 120 is being held down on this trailing part of the web. During this folding operation a vaccum is established through the fabric web from below the label to hold the label in place, and at this time the label-applying head 120 is retracted upward (FIG. 19) by the air cylinder 122. The presser member 100 continues to hold the leading end of the web folded down, as shown in FIGS. 19 and 20.

As shown in FIG. 14, the table 41 for the web is formed at the top with a pair of longitudinally extending, shallow recesses 150 and 151 on opposite sides of the web which receive and locate the bottom of the opposite sides 110 and 111 of the presser member 100 when the latter is in its down position.

Also, as shown in FIGS. 18 and 20, the side 110 of presser member 100 is generally L-shaped, with a rectangular recess or opening at the back. This facilitates the movement of a transfer shoe transversely from this side of the presser member 100 to a position overlying the folded-over end of the web and the label, as now to be described.

Figure 21:
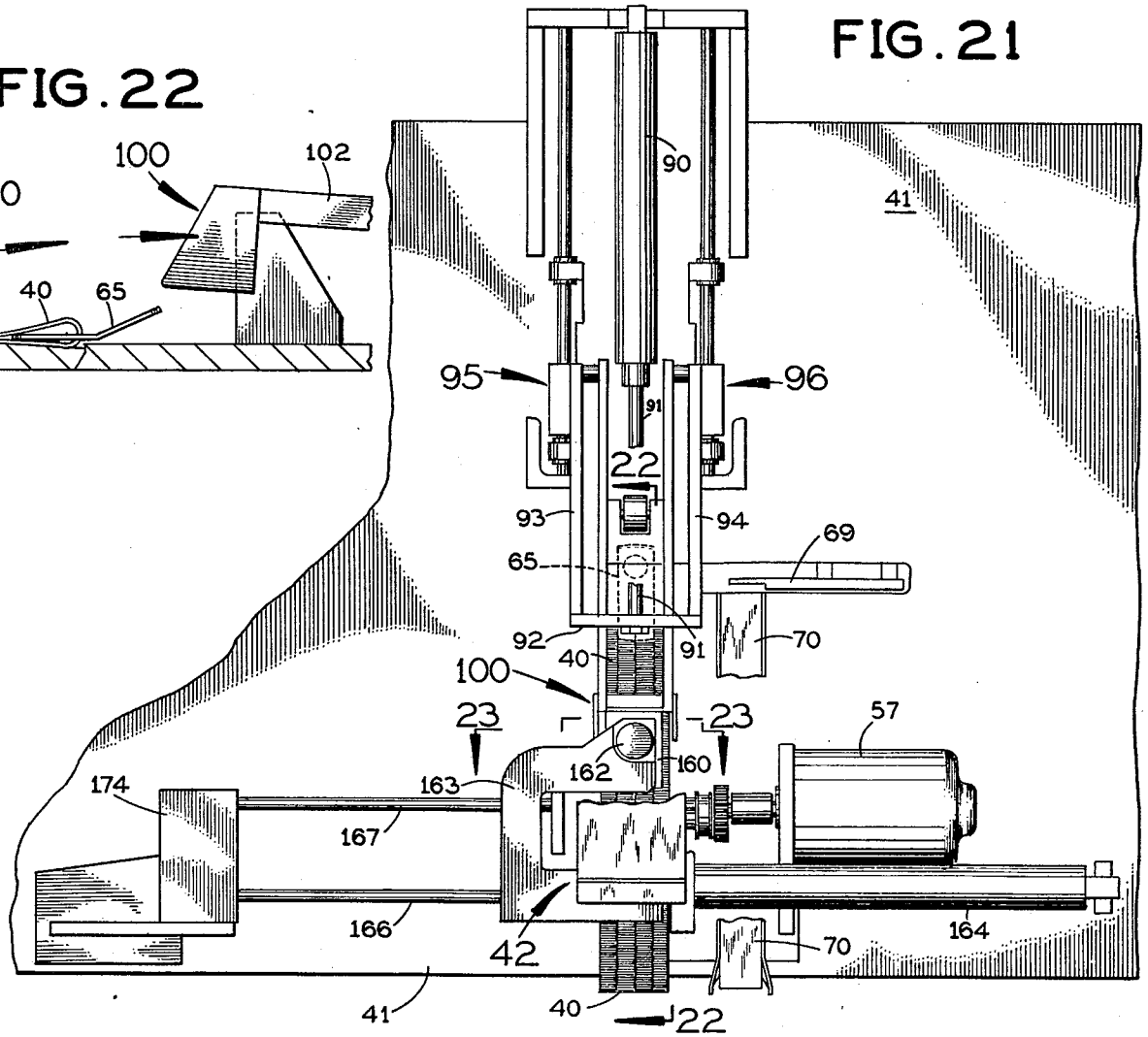
FIG. 21 is a top plan view taken along the line 5—5 in FIG. 1 showing the positions of the parts after the leading end of the web has been folded over and the web transfer mechanism has been moved to a position overlying the folded-over end of the web.
Figure 22:
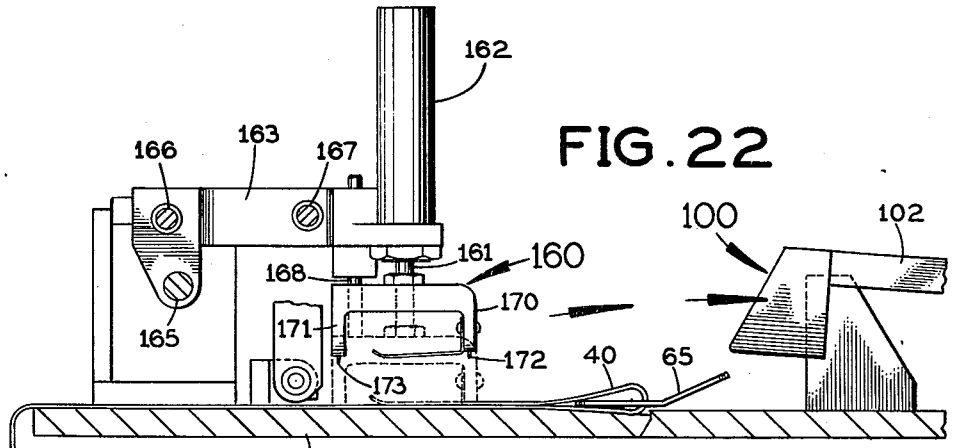
FIG. 22 is a vertical longitudinal section taken along the line 22—22 in FIG. 21 with the web transfer head in its raised position.
Figure 23:
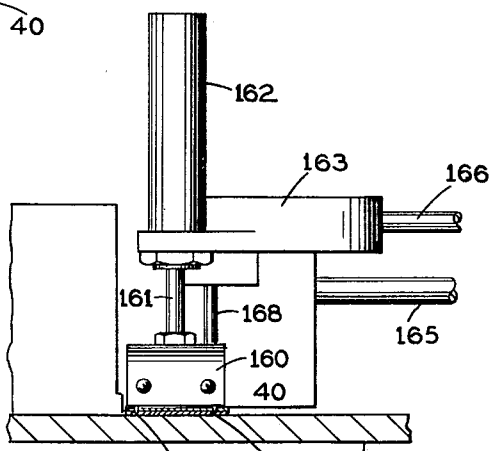
FIG. 23 is a vertical cross-section taken along the line 23—23 in FIG. 21 with the web transfer head down on the web.

Referring to FIG. 22, the transfer shoe 160 is attached to the lower end of a piston rod 161, which is connected to a piston that is slidably reciprocable inside a vertical air cylinder 162. This air cylinder is mounted on top of a generally U-shaped transfer head 163 (FIG. 21) which is reciprocated horizontally above the web and transverse to the web by a horizontal air cyinder 164 whose piston rod 165 (FIG. 22) is connected to the transfer head. The transfer head 163 is slidably mounted on fixed horizontal guide rods 166 and 167 for movement between a retracted position at one side of the web and a second positin overlying the web. The transfer head 163 slidably receives a vertical guide rod 168 (FIG. 22) whose lower end is fastened to the transfer shoe 160.

The transfer shoe 160 is of substantially inverted U-shape in vertical section, with a depending leg 170 at its right end in FIG. 22 which is shorter than a depending leg 171 at its opposite end by about a single web thickness. Short prongs 172 and 173 extend down from the respective end legs of the transfer shoe. These prongs are engageable with the web to bite into it when the air cylinder 162 is operated to lower the transfer shoe 160 from its normal, upwardly retracted, full-line position in FIG. 22 to its lowered, operating position, shown in phantom. The shorter end leg 170 overlies the folded-over part of the web whereas the other end leg overlies the label and a single-thickness trailing part of the web. This is the reason for making these end legs slightly unequal in length.

Normally, the horizontal cylinder 164 positions the transfer head 163 to the left of the position shown in FIG. 21, next to an upwardly projecting support block 174 for the horizontal guide rods 166 and 167. At this time, the transfer shoe 160 is in its raised position. (FIG. 22)

The horizontal cylinder 164 may be actuated to slide the transfer head 163 horizontally to the position shown in FIG. 22, overlying the web. At the same time, the air cylinder 90 begins retracting the folding device from the fully extended position shown in FIG. 20. When this happens, the raised transfer shoe 160 carried by the transfer head 163 clears the bottom leg of the L-shaped side 110 (FIG. 29) of the presser member 100 as the latter's cross piece 112 is sliding back over the folded-over end of the web.

Next the transfer shoe 160 is moved down, by actuating the vertical air cylinder 162, to a position in which the prongs 172 on its shorter leg 170 engage the folded over end of the web and the prongs 173 on its longer leg 171 engage the label and the underlying single-thickness part of the web.

As the folding device is being retracted, its roller 105 rides up across the inclined top face 108 of the cam block 106 to raise the presser member 100 up beyond the fastener member 65 so that the presser member clears the fastener member as it is retracted.

Figure 24:
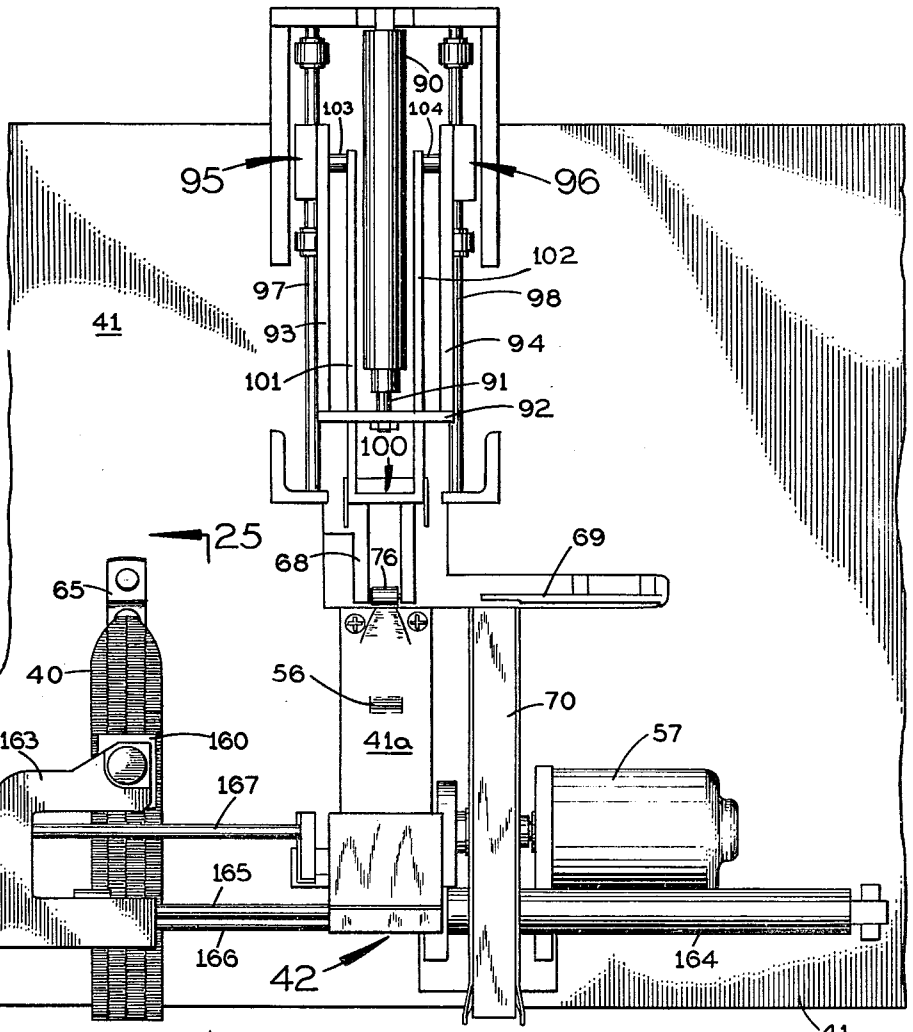
FIG. 24 is a view similar to FIG. 21 showing the positions of the parts after the web and the attached anchor plate have been slid over to the sewing position.

With the lowered transfer shoe 160 holding the end of the web folded over and the label in place on the web, the horizontal cylinder 164 is actuated to return the transfer head 163 from the position shown in FIG. 21 to the position shown in FIG. 24. The transfer shoe 160 slides the web transversely across the table 41 to a position near the sewing machines (FIG. 5).

Figure 25:
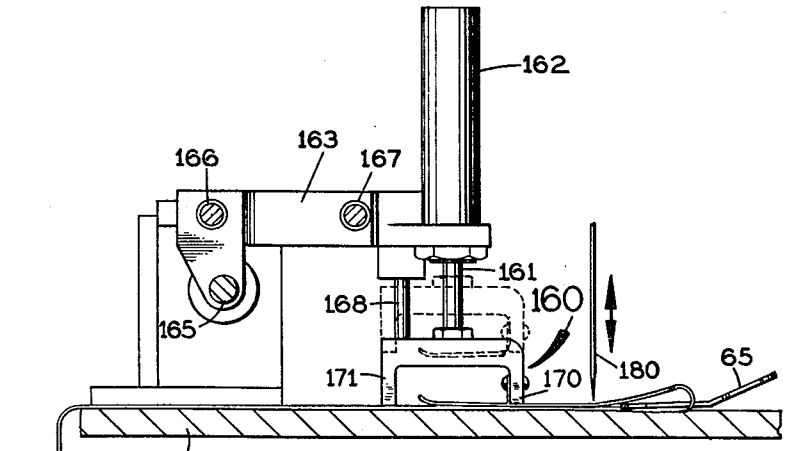
FIG. 25 is a longitudinal section taken along the line 25—25 in FIG. 24, with the web and clip held in the sewing position.
Figure 26:
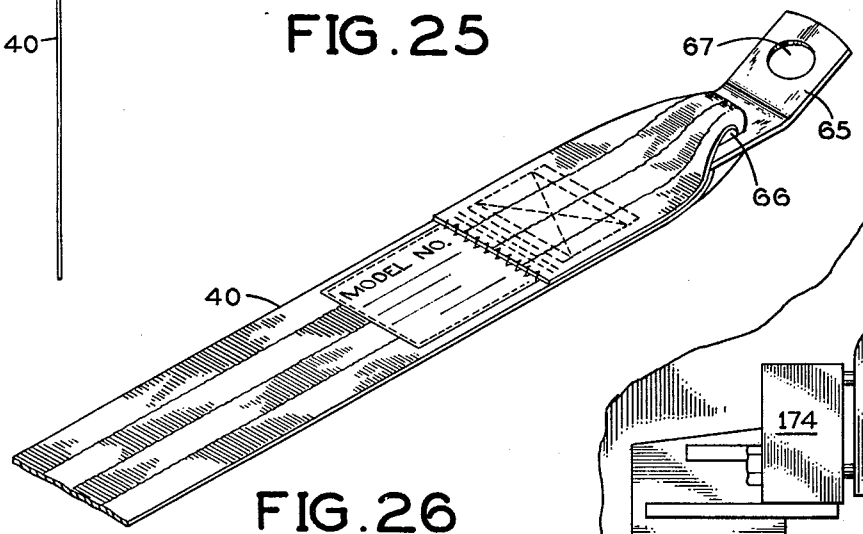
FIG. 26 is a fragmentary perspective view showing the finished web, anchor plate and label after the sewing operation is completed.

The sewing machine preferably is programmed to sew a predetermined stitching pattern which sews the folded-over end of the web and the label permanently to the underlying trailing part of the web, as shown in FIG. 26, for example. This sewing operation permanently anchors the end loop in the web at its folded-over end to the apertured fastener member 65. FIG. 25 shows the vertically reciprocable needle 180 of the sewing machine schematically. It is to be understood that the stitching pattern shown in phantom in FIG. 26 is merely illustrative, and that any desired type of automatic operation of the sewing machine may be used.

While the foregoing description and the accompanying drawing show a floor anchor as the apertured fastener member, it is to be understood that the fastener member might be a seat belt buckle or a clip. Also, the present apparatus may be used to form a loop at the web end without any apertured fastener member in the loop.

Preferably, a minimum of two and a maximum of four fastener members 65 are in the chute 70 at any given time, and the machine operator should insert a single fastener in the chute at the beginning of each cycle of operation of the apparatus.

A complete cycle of operation of the machine has the following 24 steps, some of which are simultaneous and the remainder of which occur in the sequence indicated:

1. The machine operator inserts a fastener member into the top of a chute 70, which already has at least two fastener members in it.
2. The machine operator inserts the leading end of a pre-cut fabric web 40 into the web forming device 42.
3. The motor-driven rollers 127 and 128 in the web forming device 42 advance the web to the limit switch actuator 85 at the inclined guide on the front end of the web forming device.
4. Cylinder 50 raises the web forming device 42 up from the table.
5. Simultaneously with step 4, a vacuum is established in the label applying head 120.
6. The label applying head 120 is lowered.
7. Simultaneously with step 6, a label is severed from the leading end of the label roll.
8. About 0.25 second after step 6, the vacuum is removed from the label applying head 120.
9. The folding device 90-105 is operated to fold over the leading end of the web.
10. Simultaneously with step 9, a vacuum is established under the label through the fabric web to hold the label down on the web.
11. The label applying head 120 is retracted upward.
12. The label motor 129 advances the next label across the shelf opening 123.
13. Simultaneously with step 12, the transfer device 163 is moved transversely from its retracted position near the sewing machine to its extended position overlying the web.
14. The sewing cycle on the previous web is completed.
15. The transfer head 160 is lowered into engagement with the folded over end of the web and the label on the web.
16. The folding device 90-105 is retracted.
17. The vacuum through the web below the label is released.
18. Simultaneously with step 18, the transfer device 163 is retracted (with the transfer head 160 down), sliding the web and label across the table to the sewing machine.
19. The sewing clamp at the sewing maching is lowered into engagement with the folded over end of the web and the label.

20. The transfer head 160 is raised.

21. The sewing machine starts.

22. Simultaneously with step 21, the web forming device 42 is lowered to a position directly overlying the table 41.

23. The transfer plate 69 transfers a fastener member 65 from the lower end of chute 70 over onto the holder 68.

24. The web advancing motor 52 in the web forming device 42 is turned on.

To permit more cryptic descriptions of the functions and their controls, a list of acronyms is defined below:

| FUNCTION | ACRONYM |
|---|---|
| 1. Web drive motor 57 on | WEB MTR |
| 2. Fastener member 65 in place on holder 68 | HDW POSN |
| 3. Web operates limit switch 86 | WEB IN |
| 4. Web forming device 42 up | FORM UP |
| 5. Web forming device 42 down | FORM DN |
| 6 Folding device 90-105 retracted | FLD HOME |
| 7. Folding device extended | FLD FLDG |
| 8. Labeler 120 up | LBLR UP |
| 9. Labeler down | LBLR DN |
| 10. Label available | LBL AVAIL |
| 11. Label drive motor 129 on | LBL MTR |
| 12. Vacuum on at labeler 120 | LBL VAC |
| 13. Fastener member feed | HDW FEED |
| 14. Transfer device 163 retracted | XFR SEW |
| 15. Transfer device extended | XFR FORM |
| 16. Transfer head 160 down | XFR DN |
| 17. Sew cycle on | SEW MTR |
| 18. Web vacuum on | WEB VAC |

Ten basic functions exist in the system which produce the foregoing 24 steps in one machine cycle. The functions are controlled by various switch signals. Their interrelationships are defined by the following logic equations:

| | | |
|---|---|---|
| 1. WEB MTR | = | (HDW POSN) (WEB IN) |
| 2. FORM DN | = | ~~(WEB IN)~~/(WEB IN) (FLD HOME) (XFR SEW) |
| 3. LBLR DN | = | (LBLR UP (FORM UP) (XFR SEW) (WEB IN)(LBL AVAIL) ~~(FLD FLDG) (XFR DN)~~ |
| 4. FLD FLDG | = | FORM UP) ~~(XFR ON)~~ (LBLR DN + ~~(FLD HOME)~~ (WEB IN) |
| 5. XFR FORM | = | (FORM UP) (LBLR UP) ~~(FLD HOME)~~ |
| 6. XFR DN | = | (XFR FORM) + (FLD HOME) ~~(XFR SEW)~~ |
| 7. SEW MTR | = | (XFR SEW) (XFR DN) |
| 8. LBL MTR | = | ~~(LBL AVAIL)~~ (LBLR UP) |
| 9. LBL VAC | = | (WEB IN) (LBL AVAIL) |
| 10. HDW FEED | = | ~~(HDW POSN)~~ (FORM DN) |

Taking equation 2 above as an example, the web forming device 42 will be down as long as all of the following conditions are satisfied:

the web limit switch 86 is not operated;

the folding device 90-105 is retracted;

the transfer device 163 is retracted; and the label applying head 120 is retracted upwardly. (The last three conditions are sensed by switches associated with these devices.)

Of the foregoing ten basic functions, only two are motor functions (for the web drive motor 57 in the web forming device 42, and the label drive motor 129, respectively). The remaining eight functions are performed by solenoid valves which control the respective air cylinders, namely, cylinder 50 for the web forming device 42, cylinder 122 for the label applying head 120, cylinder 90 for the folding device, cylinder 164 for transfer device 163, cylinder 162 for transfer head 160, and cylinder 71 for the fastener transfer mechanism.

The sensors which control the operation of the motors and solenoid valves are all switches. Three of these are limit switches: namely, the limit switch 86 operated by the leading edge of the web, a limit switch for sensing the presence of a label extending across the shelf opening 163, and a limit switch which senses that a fastener member 165 is in place on the holder 168. The remaining sensor switches in the control system are magnetic reed switches which sense the respective positions of the pistons in the corresponding air cylinders.

With the foregoing outline of the control system timing and logic, a detailed circuit diagram of the electric control system is considered to be unnecessary.

The apparatus preferably has a control panel (not shown) with indicator lights which tell the conditiion of the critical components in the control system so as to inform the machine operator when the apparatus is conditioned properly to perform any particular operation.

From the foregoing detailed disclosure of a presently-preferred embodiment it will be evident that the present invention constitutes an efficient and practical apparatus for providing end loops in seat belts and the like and, where desired, for attaching apertured fastener members to these end loops. The human operator merely has to insert the apertured fastener members in the chute 70, feed the pre-cut lengths of fabric web into the web forming device 42, remove the completed belt and fastener member assemblies from the apparatus, and replenish the label roll and sewing thread from time to time; all other operations are performed automatically by the present apparatus.

We claim:

1. In an apparatus for forming a sewn loop on one end of an elongated, flexible fabric web, the combination of:

a support table having a horizontal, web supporting top surface;

means for advancing the web lengthwise along a predetermined path across the table;

means for folding the leading end of the web back over a trailing part of the web;

a transfer device mounted above the table for adjustment transversely of said path of the web between a retracted position adjacent a sewing machine at one side of the web and an extended position overlying the folded-over leading end of the web;

and means for moving said transfer device to said extended position when the leading end of the web is folded over and for actuating said transfer device to engage the folded-over web from above and thereafter for moving said transfer device transversely to said retracted position to slide the web transversely across the table to a position to be sewn by the sewing machine.

2. An apparatus according to claim 1, wherein said folding means is operative to hold down the folded-over leading end of the web substantially until the transfer device is actuated to engage the folded-over end of the web from above.

3. An apparatus according to claim 2, wherein said transfer device has a head which is vertically adjustable between a raised position and a lowered position and which has downwardly-extending prongs on the bottom for engaging the folded-over end of the web in its lowered position.

4. An apparatus according to claim 1, and further comprising:

means for applying a label on top of the web next to its folded-over end before the transfer device engages the web;

and wherein said transfer device engages both the label and the folded-over end of the web when it slides the web transversely across the table to the position to be sewn.

5. An apparatus according to claim 4, and further comprising a sewing machine programmed to sew both the label and the folded-over end of the web to the underlying trailing part of the web.

6. An apparatus according to claim 4, wherein:

said means for applying a label is operative to position the label on the web and hold it there before the leading end of the web is completely folded over;

and said means for folding over the leading end of the web is operative to slide the latter longitudinally over the underlying trailing part of the web until it engages the label.

7. An apparatus according to claim 2, wherein said means for folding over the leading end of the web comprises:

a folding device mounted for generally horizontal reciprocation longitudinally of the web between a retracted position in front of the leading end of the web and an extended position overlying the web and holding its leading end folded over;

and means for moving said folding device from said retracted position to said extended position when the leading edge of the web is advanced to a predetermined position.

8. An apparatus according to claim 7, wherein said folding device has a horizontally pivoted head, and means for lowering said head during the movement of the folding device to said extended position for engaging and folding down the leading end of the web and holding it down on the trailing part of the web.

9. An apparatus according to claim 8, wherein said folding device also comprises:

rigid arm means carrying said head at one end and extending away from said head longitudinally of the direction of web advance, means providing a horizontal pivot for said arm means away from said head, and roller means carried by said arm means between its pivot and said head;

means for translating said arm means longitudinally toward and away from the web;

and a stationary cam block positioned below said arm means for engagement by said roller means to control the vertical position of said head, said cam block having a top surface which is inclined downward in a direction longitudinally toward the web for lowering said head as said roller means rolls down said inclined surface during the movement of said folding device to its extended position and for raising said head as said roller means rolls back up said inclined surface during the return of said folding device from its extended position to its retracted position.

10. An apparatus according to claim 9, wherein said means for translating said arm means comprising an air cylinder-and-piston operatively coupled to said arm means for displacing the latter longitudinally.

11. An apparatus according to claim 8, wherein said head comprises opposite vertical sides spaced apart slightly more than the width of the web, and a horizontal cross piece extending between said sides at the bottom of the head for engaging the leading end of the web.

12. An apparatus according to claim 11, wherein said cross piece on the head has a knurled bottom face for gripping the leading end of the web and sliding it over the underlying trailing part of the web after it is folded over.

13. An apparatus according to claim 11, wherein the side of said head which is closer to said transfer device in the latter's retracted position is generally L-shaped to provide a clearance for the transfer device when the latter moves from said retracted position at said one side of the web to said extended position overlying the web.

14. An apparatus according to claim 2, and further comprising means for folding the web longitudinally and passing it through an apertured fastener member as it is advanced longitudinally and before it is folded over.

15. An apparatus according to claim 14, and further comprising:

a horizontally pivoted web forming device carrying said means for advancing the web and said means for folding the web longitudinally;

and means for moving said web forming device pivotally between a lowered operative position directly overlying the table and engaging the web and a raised inoperative position extending up from the table and disengaged from the web.

16. An apparatus according to claim 15, wherein said means for advancing the web includes motor-driven roller means on the web forming device for overlying engagement with the web in said lowered position of the web forming device, said roller means having two laterally spaced peripheral grooves to crack the web longitudinally as it passes beneath.

17. An apparatus according to claim 16, wherein said table carries means presenting an upwardly-facing recess below said roller means with a width substantially equal to the roller width between the outer edges of said grooves.

18. An apparatus according to claim 17, and further comprising forming means on said web-forming device in front of said roller means in the direction of the web advance for gradually folding the web up longitudinally at said laterally spaced positions as the web advances through said forming means.

19. An apparatus according to claim 18, and further comprising:

a knurled drive roller on said web-forming device for engaging the web before it reaches said first-mentioned roller means;

and a motor on said web-forming device operatively coupled in driving relationship to said knurled roller and said first-mentioned roller means.

20. An apparatus according to claim 19, wherein:

said table has an opening therein immediately in front of said forming means in the web forming device;

and further comprising:

a holder positioned below said table for holding an apertured fastener member in an upright position at said opening in the table, with an aperture in the fastener member positioned to pass the longitudinally folded web as it emerges from said forming means in the web forming device.

21. An apparatus according to claim 20, wherein:

said holder is horizontally pivoted;

and further comprising:

means operatively connected to said folding means for rocking said holder to move said fastener member from said upright position to a generally horizontal position after the leading end of the web passes through said aperture in the fastener member.

22. An apparatus according to claim 7, and further comprising:

a web forming device having forming means therein for folding the web longitudinally as it is advanced longitudinally;

said table having an opening therein immediately in front of said forming means in the web forming device;

a horizontally pivoted holder below the table for holding an apertured fastener member in an upright position at said opening in the table, with an aperture in the fastener member positioned to pass the longitudinally folded web as it emerges from said forming means in the web forming device;

and a finger connected to said folding device for longitudinal reciprocation in unison therewith, said finger slidably engaging said holder to rock the latter for moving said fastener member from said upright position to a generally horizontal position when the folding device is moved from its retracted position to its extended position.

23. An apparatus according to claim 2, and further comprising:

a web forming device horizontally pivoted for adjustment between a lowered position directly overlying said table ahead of said means for folding over the web and a raised position extending up from said table, said web forming device carrying rollers for engaging the web in said lowered position of the web forming device to advance the web across the table and a guide in front of said rollers for slidably receiving the leading end of the web in said lowered position of the web forming device;

means for raising and lowering said web forming device;

and a limit switch on said web forming device having an actuator at said guide which is engageable by the leading edge of the web to operate the switch when said leading edge of the web reaches a predetermined position along said guide, said limit switch being operatively connected to said raising and lowering means to cause the latter to raise said web forming device from its lowered position when the switch is operated by the leading end of the web.

24. An apparatus according to claim 23, wherein said guide is on the front end of said web forming device and is upwardly and forwardly inclined.

25. An apparatus according to claim 24, and further comprising means for actuating said folding means to fold the leading end of the web back over the trailing part of the web as said web forming device is raised from its lowered position.

26. An apparatus according to claim 25, and further comprising forming means on said web forming device between said rollers and said guide for folding the web longitudinally and passing it through an apertured fastener member.

27. An apparatus according to claim 26, wherein:

said table has an opening therein between said rollers and said forming means on the web forming device;

and further comprising:

a holder positioned below said table for holding an apertured fastener member in an upright position at said opening in the table, with an aperture in the fastener member positioned to pass the longitudinally folded web as it emerges from said forming means in the web forming device.

28. An apparatus according to claim 27, wherein:

said holder is horizontally pivoted;

and further comprising:

means operatively connected to said folding means for rocking said holder to move said fastener member from said upright position to a generally horizontal position after the leading end of the web passes through said aperture in the fastener member.

29. In an apparatus for forming an end loop in an elongated, flexible, fabric web, the combination of:

a support table having a horizontal, web supporting top surface;

a web forming device horizontally pivoted for adjustment between a lowered position directly overlying said table and a raised position extending up from said table, said web forming device carrying motor-driven rollers for engaging the web in said lowered position of the web forming device to advance the web across the table and a guide in front of said rollers for slidably receiving the leading end of the web in said lowered position of the web forming device;

means for raising and lowering said web forming device;

and a limit switch on said web forming device having an actuator at said guide which is engageable by the leading edge of the web to operate the switch when said leading edge of the web reaches a predetermined position along said guide, said limit switch being operatively connected to said raising and lowering means to cause the latter to raise said web forming device from its lowered position when the switch is operated by the leading edge of the web.

30. An apparatus according to claim 29, and further comprising:

means for folding the leading end of the web back over the trailing part of the web as said web forming device is raised from its lowered position.

31. An apparatus according to claim 30, and further comprising:

a transfer device operable to engage the folded-over end of the web from above and slide the web across the table to a sewing machine.

32. An apparatus according to claim 31, wherein said web forming device is horizontally pivoted at its back end, and said guide is on the front end of the web-forming device and is inclined upward and forward, whereby to slidably receive the leading end of the web as the web is advanced and to slidably release and begin folding over the leading end of the web as the web forming device is pivoted from its lowered position to its raised position.

33. An apparatus according to claim 32, and further comprising:

a holder mounted below said web forming device for supporting an apertured fastener member substantially upright ahead of said guide, with an aperture in said fastener member positioned in the path of the advancing web;

and web forming means in said web forming device for folding the web longitudinally before it reaches said apertured fastener member.

34. In an apparatus for forming an end loop in an elongated, flexible fabric web, the combination of:

a support table having a horizontal, web supporting top surface;

means for advancing the web lengthwise along a predetermined path across the table;

a folding device mounted for generally horizontal reciprocation above the table longitudinally of the web between a retracted position in front of the leading end of the web and an extended position overlying the web and holding its leading end folded over, said folding device having a horizontally pivoted head; means for moving said folding device from said retracted position to said extended position when the leading end of the web is advanced to a predetermined position;

and means for lowering said head during the movement of the folding device to said extended position for engaging and folding down the leading end of the web and holding it down on the trailing part of the web.

35. An apparatus according to claim 34, wherein said folding device also comprises:

rigid arm means carrying said head at one end and extending away from said head longitudinally of the direction of web advance, means providing a horizontal pivot for said arm means away from said head, and roller means carried by said arm means between its pivot and said head;

means for translating said arm means longitudinally toward and away from the web;

and a stationary cam block positioned below said arm means for engagement by said roller means to control the vertical position of said head, said cam block having a top surface which is inclined downward in a direction longitudinally toward the web for lowering said head as said roller means rolls down said inclined surface during the movement of said folding device to its extended position and for raising said head as said roller means rolls back up said inclined surface during the return of said folding device from it extended position to its retracted position.

36. An apparatus according to claim 35, wherein said head comprises opposite vertical sides spaced apart slightly more than the width of the web, and a horizontal cross piece extending between said sides at the bottom of the head for engaging the leading end of the web.

37. In an apparatus for assembling an elongated, flexible fabric web to an apertured fastener member, the combination of:

a support table having a horizontal, web supporting top surface;

means for advancing the web lengthwise along a predetermined path across the table;

means for folding the leading end of the web back over a trailing part of the web;

said table having an opening therein ahead of said folding means;

a horizontally pivoted holder below the table for holding an apertured fastener member upright at said opening in the table, with an aperture in the fastener member positioned to pass the web as it is advanced along said path;

and means for rocking said holder to support the apertured fastener member substantially horizontally as the leading end of the web is folded over.

38. An apparatus according to claim 37, wherein:

said folding means is reciprocable above the table longitudinally of said path of the web advance;

and said means for rocking the holder is operatively connected to said folding means for reciprocation in unison therewith.

39. An apparatus according to claim 4, wherein said means for applying a label comprises:

a reel holding a roll of labels above the table;

a support shelf for the leading end of the roll of labels having an opening therein above the table;

a vertically reciprocable cutter at said opening for severing a label from the leading end of the roll;

and a vertically reciprocable head at said opening for engaging the severed label and moving it down onto the web on the table.

40. In an apparatus for forming a loop at one end of an elongated fabric web and attaching a label to the web next to said loop, the combination of:

a support table having a horizontal, web supporting top surface;

a web forming device horizontally pivoted for adjustment between a lowered position directly overlying said table and a raised position extending up from said table, said web forming device carrying motor-driven rollers for engaging the web in said lowered position of the web forming device to advance the web in a predetermined path across the table and a guide in front of said rollers for slidably receiving the leading end of the web in said lowered position of the web forming device;

means for pivotally raising and lowering said web forming device;

means operable by the leading end of the web for actuating said last-mentioned means to raise the web forming device;

a vertically reciprocable label applying mechanism above the table;

means for lowering said label applying mechanism to apply a label from above onto the web a short distance behind its leading end and to hold the web on the table after the web forming device is raised;

a web folding device operative to fold the leading end of the web back over a trailing part of the web while said label applying mechanism is holding the label down on the web and is holding the web on the table;

means for retracting said label applying mechanism upward while the leading end of the web is held folded over by said web folding device;

and a transfer device operative, when the web folding device releases the folded over end of the web, to engage from above the folded over end of the web and the label and slide the web and applied label across the table to a sewing machine at one side of said web folding device.

* * * * *